US008444376B2

(12) United States Patent
Krueckels et al.

(10) Patent No.: US 8,444,376 B2
(45) Date of Patent: May 21, 2013

(54) COOLED CONSTRUCTIONAL ELEMENT FOR A GAS TURBINE

(75) Inventors: Joerg Krueckels, Birmenstorf (CH); Milan Pathak, Ennetbaden (CH)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 13/192,656

(22) Filed: Jul. 28, 2011

(65) Prior Publication Data

US 2012/0020768 A1 Jan. 26, 2012

Related U.S. Application Data

(63) Continuation of application No. PCT/EP2010/051018, filed on Jan. 28, 2010.

(30) Foreign Application Priority Data

Jan. 30, 2009 (CH) ..... 0140/09

(51) Int. Cl.
*F04D 31/00* (2006.01)

(52) U.S. Cl.
USPC ..... 415/116

(58) Field of Classification Search
USPC ..... 416/97 A, 96 R, 95, 90 R, 97 R
See application file for complete search history.

(56) References Cited

U.S. PATENT DOCUMENTS

| | | | | |
|---|---|---|---|---|
| 4,712,979 | A | 12/1987 | Finger | |
| 4,719,748 | A | 1/1988 | Davis et al. | |
| 5,321,951 | A * | 6/1994 | Falls et al. | 60/748 |
| 6,343,914 | B1 * | 2/2002 | Ferber et al. | 416/193 A |
| 6,402,464 | B1 | 6/2002 | Chiu et al. | |
| 6,439,846 | B1 | 8/2002 | Anderson et al. | |
| 6,779,597 | B2 | 8/2004 | DeMarche et al. | |
| 7,097,418 | B2 | 8/2006 | Trindade et al. | |
| 2002/0062945 | A1 * | 5/2002 | Hocker et al. | 165/53 |
| 2008/0190114 | A1 * | 8/2008 | Surace et al. | 60/806 |

FOREIGN PATENT DOCUMENTS

EP 0889201 A1 1/1999

OTHER PUBLICATIONS

European Patent Office, International Search Report for PCT/EP2010/051018, mailed May 3, 2010.

* cited by examiner

*Primary Examiner* — Nathaniel Wiehe
*Assistant Examiner* — Adam W Brown
(74) *Attorney, Agent, or Firm* — Leydig, Voit & Mayer, Ltd.

(57) ABSTRACT

A cooled constructional element for a gas turbine includes a wall having a front and a rear side. The front side is configured to be thermally loaded during operation of the turbine, and the rear side has a plurality of pins projecting therefrom in a two-dimensional distribution, the two-dimensional distribution including a higher density distribution of pins in a critical zone of the cooled constructional element than in the remaining regions of the cooled constructional element. A device is configured to create jets of a cooling medium that are directed onto the rear side of the wall in a region of the plurality of pins so as to cool the rear side of the wall by impingement.

5 Claims, 2 Drawing Sheets

COOLED CONSTRUCTIONAL ELEMENT FOR A GAS TURBINE

CROSS REFERENCE TO PRIOR APPLICATIONS

This application is a continuation of International Patent Application No. PCT/EP2010/051018, filed on Jan. 28, 2010, which claims priority to Swiss Patent Application No. CH 00140/09 filed on Jan. 30, 2009.

FIELD

The present invention relates to the field of gas turbines.

BACKGROUND

Gas turbines are designed for ever higher operating temperatures for increasing the efficiency. In this case, especially the components or constructional elements in the region of the combustor and also the rotor blades and stator blades of the subsequent turbine, including the remaining elements which delimit the hot gas passage, are exposed to exceptional thermal loads. In order to efficiently counteract the occurring thermal loads, on the one hand especially resistant materials, such as nickel-based alloys, can be used. On the other hand, additional measures must be adopted for cooling the constructional elements, wherein different cooling methods, such as film cooling or impingement cooling, are used.

U.S. Pat. No. B2-6,779,597 describes multistage impingement cooling structures in the case of constructional elements of gas turbines, in which structures a wall, the front side of which faces the hot gas passage, is correspondingly impingement cooled on the rear side by means of perpendicularly impinging cooling air jets which are created by means of corresponding impingement cooling holes. The cooling effect in this case is intensified by means of projecting posts or pins which are in a distributed arrangement on the rear side and enlarge the heat-dissipating surface and intensify turbulences in the cooling air flow. The distributions of the impingement cooling holes and pins in the surface are constant in this case. The diameters of the impingement cooling holes in this case correspond to the diameter of the pins at the base. The density of the holes is considerably lower than the density of the pins.

U.S. Pat. No. 4,719,748 describes impingement cooling in the transition pipe between the individual burners and the inlet of the subsequent turbine, in which cooling air jets, which are created by means of impingement cooling holes, are directed onto the rear side of the pipe walls. By variation of the hole size and/or of the distances between the holes and/or of the distances from the holes to the pipe wall, the cooling intensity is varied and adapted to the respective thermal load. Pins for improving the transfer of heat are not provided.

Particular importance is attached to the cooling of the stator blades in the first stages of the turbine, because in this region the highest temperatures in the gas turbine occur. U.S. Pat. No. B2-7,097,418 describes how the outer platform of a stator blade can be cooled in a particularly simple manner by means of two-stage impingement cooling, wherein in a first stage the region at the trailing edge of the blade is cooled, and then the cooling air which discharges there cools the platform at the leading edge in a second stage. In both stages, differently positioned and spaced impingement cooling holes (30, 38 in FIG. 3) are used. Pins are not used on the rear side of the platform base.

The variation of the impingement cooling holes for adapting to the varying thermal loads usually results in the necessary amount of cooling air also being altered. If more holes per area unit are used—with hole diameters remaining the same—the consumed amount of cooling air is also increased, which leads to a reduction of the efficiency of the machine.

SUMMARY OF THE INVENTION

The present invention provides a cooled constructional element for a gas turbine. The cooled constructional element includes a wall having a front and a rear side. The front side is configured to be thermally loaded during operation of the turbine, and the rear side has a plurality of pins projecting therefrom in a two-dimensional distribution, the two-dimensional distribution including a higher density distribution of pins in a critical zone of the cooled constructional element than in the remaining regions of the cooled constructional element. A device is configured to create jets of a cooling medium that are directed onto the rear side of the wall in a region of the plurality of pins so as to cool the rear side of the wall by impingement.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

The present invention provides a cooled constructional element for a gas turbine and a method for operating such a constructional element.

An aspect of the invention is to create a cooled constructional element of a gas turbine, especially in the case of a stator blade which is provided with a platform, the cooling of which is optimally adapted to the locally varying thermal load without creating an unnecessary increase in consumption of cooling air, i.e. minimization of the cooling air used with the same cooling intensity is achieved.

In an embodiment of the invention the thermally loaded wall which is to be cooled has a large number of pins which project from the wall on its rear side in a two-dimensional distribution, and in that the distribution of the pins has a higher density inside the thermal critical zones of the constructional element than in the remaining regions. As a result of this, the transfer of heat between wall and cooling air can be locally altered and adapted to the thermal load without a larger amount of cooling air having to be necessarily used.

One embodiment of the invention includes means for creating the jets which are directed on the rear side of the wall comprising an impingement cooling plate which is provided with impingement cooling holes in a distributed arrangement.

The cooling is particularly effective if, according to another embodiment of the invention, the impingement cooling plate is arranged at a distance parallel to the rear side of the wall, and if the distribution of the impingement cooling holes is matched to the distribution of the pins in such a way that the impingement cooling holes lie between the pins in each case, as seen in a direction perpendicular to the impingement cooling plate. As used herein, parallel means essentially parallel.

The variation of the cooling can be intensified by the density of the impingement cooling holes being correlated with the density of the pins. In particular, the density of the impingement cooling holes and the density of the pins can locally be the same.

The constructional element is preferably a stator blade of a gas turbine, which comprises a blade airfoil extending in a longitudinal direction and a platform which adjoins the blade airfoil and extends transversely to the longitudinal direction, the base of which platform is the thermally loaded, impingement-cooled wall and forms a concavity at the transition to the blade airfoil, wherein the distribution of the pins towards the concavity has a higher density than in the remaining regions which are at a distance from the concavity.

Figure 1:
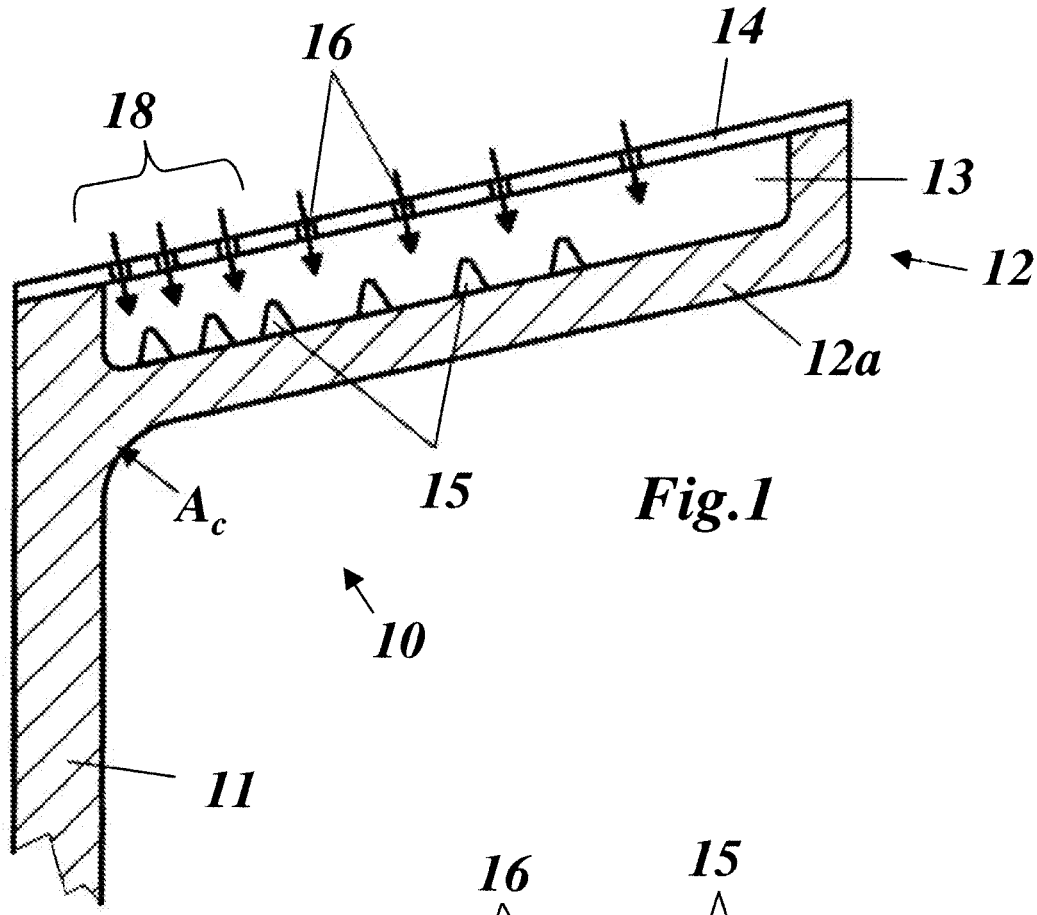
FIG. 1 shows a longitudinal section through the upper section of a gas-turbine stator blade with platform, with locally varying impingement cooling, according to an exemplary embodiment of the invention.

In FIG. 1, the upper section of a gas-turbine stator blade with platform and locally varying impingement cooling according to an exemplary embodiment of the invention is reproduced in longitudinal section. It comprises a blade airfoil 11 which extends in the longitudinal direction of the blade and on the upper end of which is formed a platform 12 which extends essentially transversely to the longitudinal direction of the blade. The platform 12 has a base or a wall 12*a*, the underside of which is impinged upon by the hot gas which flows through the turbine and which on the upper side is cooled by means of impingement cooling.

Figure 2:
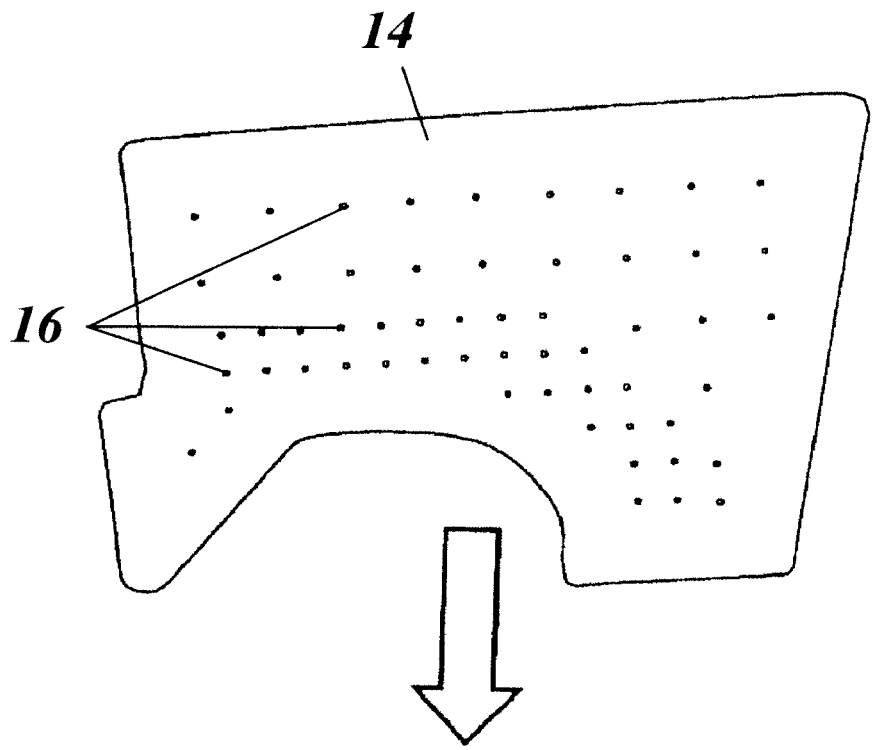
FIG. 2 shows the impingement cooling plate, which is used in the stator blade from FIG. 1, in plan view from above.

For this, a cavity 13, which is covered by an impingement cooling plate 14 arranged parallel to the wall 12*a*, is formed on the upper side of the platform 12. Provision is made in the impingement cooling plate 14, in a prespecified distribution, for impingement cooling holes 16 through which the compressed cooling air in the form of individual cooling air jets (see the arrows in FIG. 1) enter the cavity 13 and impinge upon the oppositely disposed rear side of the wall 12*a*. During the impingement and the subsequently following turbulent contact with the rear side of the wall 12*a*, the cooling air absorbs heat from the wall 12*a* and is then discharged from the cavity 13 (in ways not shown in FIG. 1). The two-dimensional distribution of the impingement cooling holes 16 is to be seen in FIG. 2.

Figure 4:
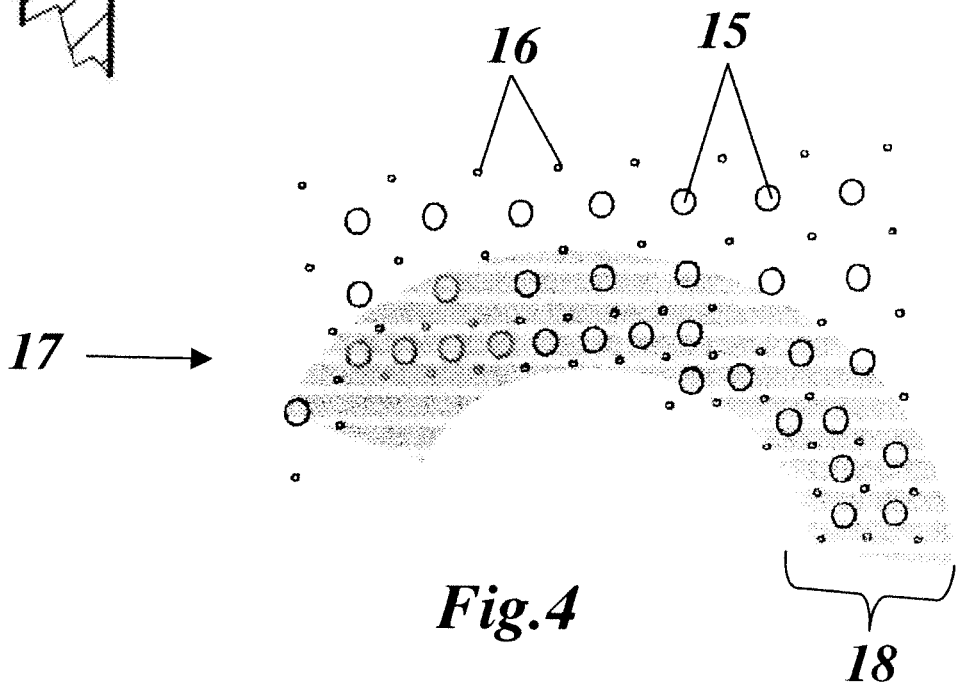
FIG. 4 shows, as seen from above, the correlated distributions of impingement cooling holes and pins according to FIGS. 1-3.
Figure 3:
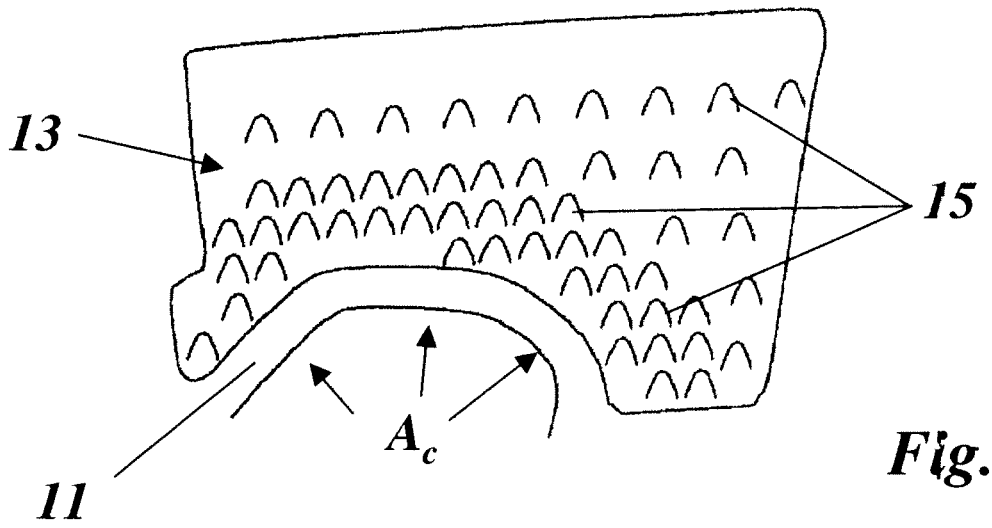
FIG. 3 shows the distribution of pins, which is used in the stator blade from FIG. 1, in plan view from above (the pins are perspectively drawn in)

For improving the transfer of heat between wall 12*a* and the cooling air, perpendicularly projecting conical or pyramid-shaped pins 15 are arranged on the rear side of the wall 12*a* (also see FIG. 3, in which the pins 15 are perspectively drawn in) and enlarge the contact area between wall and cooling air flow and intensify the turbulences. As is to be seen in FIG. 4, the density of the impingement cooling holes 16 and the density of the pins 15 is locally different but correlated with each other at the same time, i.e. in the regions where the density of the pins 15 is increased (concentrated region 18) the density of the impingement cooling holes 16 is also increased, and vice versa. In particular, the densities of the two are locally the same. The impingement cooling holes 16 are preferably arranged with the pins 15 in a "staggered" manner, that is to say with spaces. Between two parallel rows of pins 15, a row of impingement cooling holes 16 with the same periodicity are positioned in a staggered manner in each case.

Applicants have discovered, in the case of a stator blade of the type which is reproduced in FIG. 1, there are critical zones $A_c$ on the platform 12 in which provisions against thermal load are especially important. Such a critical zone is the concavity between the wall 12*a* of the platform 12 and the blade airfoil. In order to locally increase the cooling effect at this point of the platform 12, i.e. at the transition to the blade airfoil, the density of the pins 15, in a concentrated region 18 which directly adjoins the concavity (highlighted in gray in FIG. 4), is significantly increased compared with the remaining region. In addition, the density of the impingement cooling holes 16 is also increased in this region 18, in fact similarly to the density of the pins 15. The transition between the regions of different hole density and pin density in this case can be of a consistent form.

As a result of this, the heat dissipation in the region of the concavity is significantly improved, as a result of which the effects of the thermal load can be limited.

It is self-evident that within the scope of the invention and as a result of the provisions according to the invention not only critical regions of the stator blades but also other thermally loaded constructional elements of the gas turbine can be "alleviated" in a cooling-technological manner.

While the invention has been described with reference to particular embodiments thereof, it will be understood by those having ordinary skill the art that various changes may be made therein without departing from the scope and spirit of the invention. Further, the present invention is not limited to the embodiments described herein; reference should be had to the appended claims.

LIST OF REFERENCE NUMERALS

10 Stator blade (gas turbine)
11 Blade airfoil
12 Platform
12*a* Wall (platform)
13 Cavity
14 Impingement cooling plate
15 Pin
16 Impingement cooling hole
17 Impingement cooling pattern
18 Concentrated region
$A_c$ Critical zone (concavity)

What is claimed is:

1. A cooled constructional element for a gas turbine comprising:

a wall including a front side and a rear side, the front side being configured to be thermally loaded during operation of the turbine and the rear side having a plurality of pins projecting therefrom in a two-dimensional distribution, the two-dimensional distribution including a higher density distribution of pins in a critical zone of the cooled constructional element than in the remaining regions of the cooled constructional element; and an impingement cooling plate having a plurality of impingement cooling holes in a distributed arrangement and configured to create jets of a cooling medium that are directed onto the rear side of the wall in a region of the plurality of pins so as to cool the rear side of the wall by impingement, the impingement cooling plate being disposed essentially parallel at a distance to the rear side of the wall and the distributed arrangement of the plurality of cooling holes corresponding to the two-dimensional distribution of the plurality of pins such that, in a direction perpendicular to the impingement cooling plate, the plurality of cooling holes are respectively disposed between the plurality of pins.

2. The cooled constructional element as recited in claim 1, wherein a density of the plurality of impingement cooling holes is locally the same as a density of the plurality of pins.

3. The cooled constructional element as recited in claim 1, wherein the cooled constructional element is a stator blade including a blade airfoil extending in a longitudinal direction, wherein the wall is a base of a platform adjoining the blade airfoil and extending transversely to the longitudinal direction, and wherein the critical zone is an area of the rear side of the wall toward a concavity that is disposed at a transition between the blade airfoil and the platform.

4. A stator blade for a gas turbine comprising:

a blade airfoil extending in a longitudinal direction;

a platform adjoining the blade airfoil and extending transversely to the longitudinal direction, the platform including a base having a front side and a rear side, the front side being configured to be thermally loaded during operation of the turbine and the rear side having a plurality of pins projecting therefrom in a two-dimensional distribution, the two-dimensional distribution including a higher density distribution of pins in a critical zone of the stator blade than in the remaining regions of the stator blade; and an impingement cooling plate configured to create jets of a cooling medium that are directed onto the rear side of the base in a region of the plurality of pins so as to cool the rear side of the base by impingement, the impingement cooling plate being disposed essentially parallel at a distance to the rear side of the base and the distributed arrangement of the plurality of cooling holes corresponding to the two-dimensional distribution of the plurality of pins such that, in a direction perpendicular to the impingement cooling plate, the plurality of cooling holes are respectively disposed between the plurality of pins.

5. The stator blade as recited in claim 4, wherein a density of the plurality of impingement cooling holes is locally the same as a density of the plurality of pins.

* * * * *